US005347924A

United States Patent [19]

Martin

[11] Patent Number: 5,347,924

[45] Date of Patent: * Sep. 20, 1994

[54] DEVICE FOR PRINTING ENDORSEMENTS ON DOCUMENTS

[75] Inventor: Emilio B. Martin, Madrid, Spain

[73] Assignee: Amper, S.A., Spain

[ * ] Notice: The portion of the term of this patent subsequent to May 7, 2008 has been disclaimed.

[21] Appl. No.: 696,207

[22] Filed: May 6, 1991

Related U.S. Application Data

[63] Continuation-in-part of Ser. No. 347,499, May 4, 1989, Pat. No. 5,012,734.

[51] Int. Cl.[5] ..... B41L 47/46

[52] U.S. Cl. ..... 101/91; 101/76

[58] Field of Search ..... 101/76, 77, 91, 216, 101/219, 232, 233, 234, 235

[56] References Cited

U.S. PATENT DOCUMENTS 5,012,734 5/1991 Martin ..... 101/76

*Primary Examiner*—Edgar S. Burr
*Assistant Examiner*—Ren Yan
*Attorney, Agent, or Firm*—Johnson & Gibbs

[57] ABSTRACT

Device for printing endorsements on documents passing through a document processing apparatus. The device comprises a rotatable outer housing having a cylindrically shaped exterior surface and a ring gear having a toothed first part and a toothless second part. A stamp for printing endorsements and at least one band having digits or characters thereon form a substantially continuos surface with the exterior surface of the outer housing. When the endorsing device is rotated by a pinion meshing with the ring gear, the digits or characters, as well as the stamp, contact a document passing through the document processing apparatus. During the rotation of the outer housing, further rotation is prevented by an arm which engages a projection on the outer housing and biasing means which biases the arm into locked engagement with the projection. When the arm engages the projection, the pinion is unable to rotate the outer housing as the toothless part of the ring gear is now facing the pinion. To release the outer housing, the force biasing the arm into locked engagement is removed. A second biasing means rotationally biases the outer housing so that the pinion will be able to mesh with the toothed portion of the ring gear, thereby continuing the rotation of the endorsing device.

13 Claims, 3 Drawing Sheets

DEVICE FOR PRINTING ENDORSEMENTS ON DOCUMENTS

CROSS REFERENCE TO RELATED APPLICATION

This application is a continuation-in-part of U.S. Pat. Application Ser. No. 07/347,499 filed May 4, 1989, which issued on May 7, 1991, as U.S. Pat. No. 5,012,734 which is hereby incorporated by reference as if reproduced in its entirety.

BACKGROUND OF THE INVENTION

1. Field of the Invention

The invention generally relates to a device for printing endorsements on documents which may be included as part of an apparatus for reading and/or printing magnetic or non-magnetic characters. More specifically, the invention relates to a device for printing endorsements and, more particularly, to a device for printing endorsements in which the endorsing device prints specific characters on the reverse side of the document as the document's code lines are printed and/or read by a document processor such as a document reader and/or printer.

2. Description of Related Art

Existing magnetic and non-magnetic character readers/printers come in a variety of types. Most commonly, such devices are capable of reading magnetic or other types of characters imprinted on a document and/or printing magnetic or other types of characters onto the document. Typically, such devices generally include a document guide and tractor rollers. The tractor rollers propel the document through the reading and/or printing elements of the document processor where characters imprinted on the document may be read or characters may be print onto the document passing therethrough. Document processors such as those herein described may or may not be further equipped with a device for printing endorsements on the documents passing therethrough.

A device for printing endorsements print a series of characters which comprise the endorsement onto the reverse side of the document as it passes through the document guide. Typically, the device prints the endorsement on the document either by striking the document or by pressing a roller against the document. Among the disadvantages of using an impact-type endorsement device in a document processing system is that, in order to print the endorsement on a document, the advancement of a document must be stopped, the endorsing device activated to print the endorsement on the document and the advancement of the document resumed. Such a procedure results in a substantial loss of processing time. As a result, the processing of documents is slowed. Another disadvantage of using an impact-type endorsement device in a document processing system is related to the inking process itself. It is difficult to conceive of an inking system for an impact-type endorsement device which will satisfactorily operate within the size and price constraints imposed upon document processing systems.

Unlike most impact-type endorsement devices, roller-type endorsement devices do not require the document to be stopped before commencing the printing step. However, a disadvantage often present in roller-type endorsement devices is that the rotation of the roller which contacts the document continues the entire time that documents are passing through the roller-type endorsing device. As a result, unless the roller is stopped, for example, by a manual stopping operation, the roller will indiscriminately endorse all documents passing through the endorsing device. Another disadvantage of the roller-type endorsing devices is that, apart from the date, the information printed on the document is always the same, i.e., the information being printed by the roller cannot be changed without performing the slow task of removing one stamp and installing another.

Endorsement devices which print endorsements on documents using a roller rather than by impact are known. Roller-type document endorsers generally include a cylindrical casing containing an arrangement of wheels. Bands are provided containing the requisite digits and characters between the wheels and a peripheral area of the casing. In such a manner, dates and other types of inscriptions can be composed by simply turning the wheels to change the characters as desired.

The endorsing device subject of the present invention has been designed to fully solve the aforementioned problems. It is an extremely simple structure which may be mounted at the input or output of the guide along which a document passes. The endorsing device is suitable for readers and/or printers or any other type of document processing system, such as those issued by banks.

SUMMARY OF THE INVENTION

In one aspect, the present invention is of a device for printing endorsements which includes a rotatable housing, first print means and second print means. The first print means is comprised of at least one band having a plurality of digits and/or characters thereon to form a substantially continuous surface with the exterior surface of the housing and the second print means is comprised of a removable stamp held by a fitting mounted in a detent on the exterior surface of the housing. When the housing rotates, a document passing through the document guide is pressed between the digits and/or characters of the first print means and the stamp of the second print means press against the document on one side and a side surface of a roller press against the document on the other side. As a result, both the digits and the characters forming a substantially continuous surface with the exterior surface of the housing and whatever information is provided on the stamp are printed on the document.

One advantage of a document endorser constructed in accordance with the teachings of the present invention is that the endorser provides for both the characters of the first print means and the stamp of the second print means to be inked by rubbing against a single ink roller positioned adjacent the rotatable housing such that, as the rotatable housing rotates, the surface of the ink roller will tangentially connect the digits and/or characters of the first print means and the stamp of the second print means, thereby supplying the first and second print means with ink. After inking the print means, the housing continues to rotate such that the first and second print means tangentially contact between a die roller positioned on the other side of the document guide. The first and second print means press against the document and the die roller, thereby stamping the desired endorsement on the document. Furthermore, the stamp mounted on the generally cylindrical, rotatable housing, the bands bearing digits or characters, and the ink roller itself, can be easily removed and replaced. As a result, there is no difficulty in changing the stamp or characters to be printed on the document or the ink roller for inking the stamp or characters at any given moment.

In another aspect, the invention is of a device for printing endorsements in which the device is rotated by the transmission system of the document processor, for example, a reader and/or printer upon which the document endorser is mounted. The transmission system of the document processor is equipped with a pinion for interlocking with a partially toothed ring provided around the base of the endorser housing. In this aspect of the invention, the rotatable housing completes a full rotation for every document to be endorsed and stops after completing a rotation to await a next document for endorsing. The housing is rotated by a pinion which meshes with a ring provided at the base of the housing. As the ring has a first part having teeth and a second part being toothless, the pinion can only mesh with the toothed portion of the ring. After the endorser housing has been rotated 360 degrees, the endorser housing is blocked from further rotation by an arm which engages a projection on the outer housing and biasing means such as a spring which biases the arm into locked engagement with the projection. When the arm engages the projection, the pinion is unable to rotate the endorser housing as the toothless part of the ring gear is now facing the pinion. In this manner, the projecting arm, which is controlled by an electromagnet included as part of the printing/endorsing device, blocks rotation of the endorser housing. Whenever appropriate, i.e. when there is a document to be endorsed passing through the document guide, an activation order is received by the printer/reader to release the restraining arm, thereby allowing the endorser housing to revolve, thus printing the endorsement on the document passing through the guide. To activate the endorsing housing, an appropriate command must be transmitted to an electromagnet which frees the cylindrical body and allow it to revolve.

BRIEF DESCRIPTION OF THE DRAWINGS

The invention may be better understood in tis numerous objects and advantages will become apparent to those skilled in the art by reference to the following drawing in which.

DETAILED DESCRIPTION OF THE INVENTION

Figure 1:
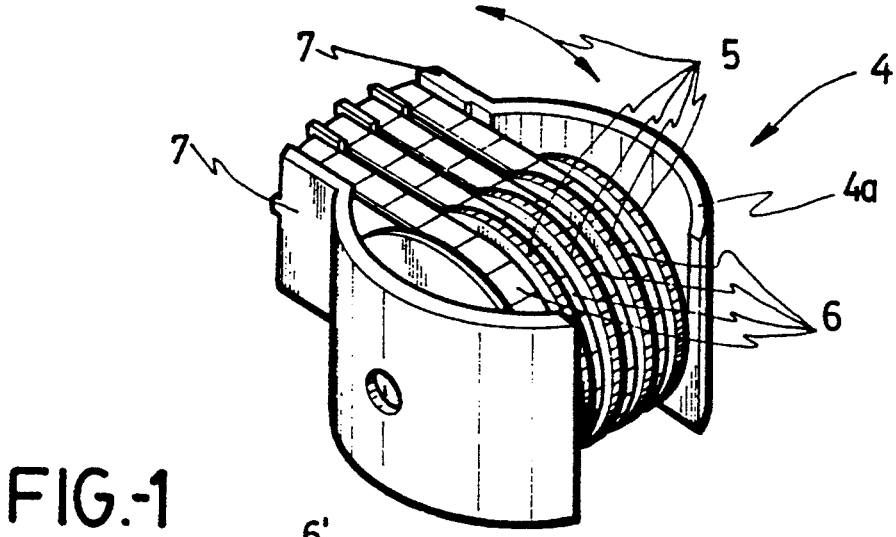
FIG. 1 is a partially exploded perspective view of a device for printing endorsements constructed in accordance with the teachings of the present invention.

Referring first to FIG. 1, a device for printing endorsements on documents which is constructed in accordance with the teachings of the present invention shall now be described in detail. The device for printing endorsements on documents is comprised of a rotatable outer cylindrical housing 1 having an interior opening and an exterior surface 1*a*. The outer cylindrical housing 1 is further provided with a notch 6' in communication with the interior opening. Integrally formed with cylindrical housing 1 is a concentric cylindrical neck 2 of reduced width which extends downwardly from the cylindrical outer housing 1. The neck 2 includes an oblique step or indentation 3 integrally formed therewith by an indentation along the surface of the cylindrical neck 2.

Mounted in the interior of cylindrical housing 1 is an inner housing 4 which, like outer cylindrical housing 1, is provided with an interior opening. Inner housing 4 is comprised of an generally cylindrical section 4*a* integrally formed with outwardly projecting flanges 7. When the inner housing 4 is inserted into the interior opening of cylindrical outer housing 1, the flanges 7 project into and are supported by the notch 6', thereby properly orientating as well as retaining the inner housing 4 within the cylindrical outer housing 1. Mounted in the interior of inner housing 4 are a plurality of continuous bands 6, each having a plurality of digits and/or characters (not shown) formed thereon. Each band 6 is mounted on a collar (not shown) and projects through the notch 6' such that a portion of each band 6 forms a substantially continuous surface at the notch 6' with the exterior surface 1*a* of the cylindrical outer housing 1. Most typically, the portion of the bands 6 forming the substantially continuous surface with the exterior surface 1*a* would typically have a single digit or character thereon. Also mounted within the interior of inner housing 4 are rotatable wheels 5. By rotating wheels 5, for example by hand, each continuous band 6 may be moved such that a different portion of that band 6 forms the substantially continuous surface with the exterior surface 1*a*.

Figure 5:
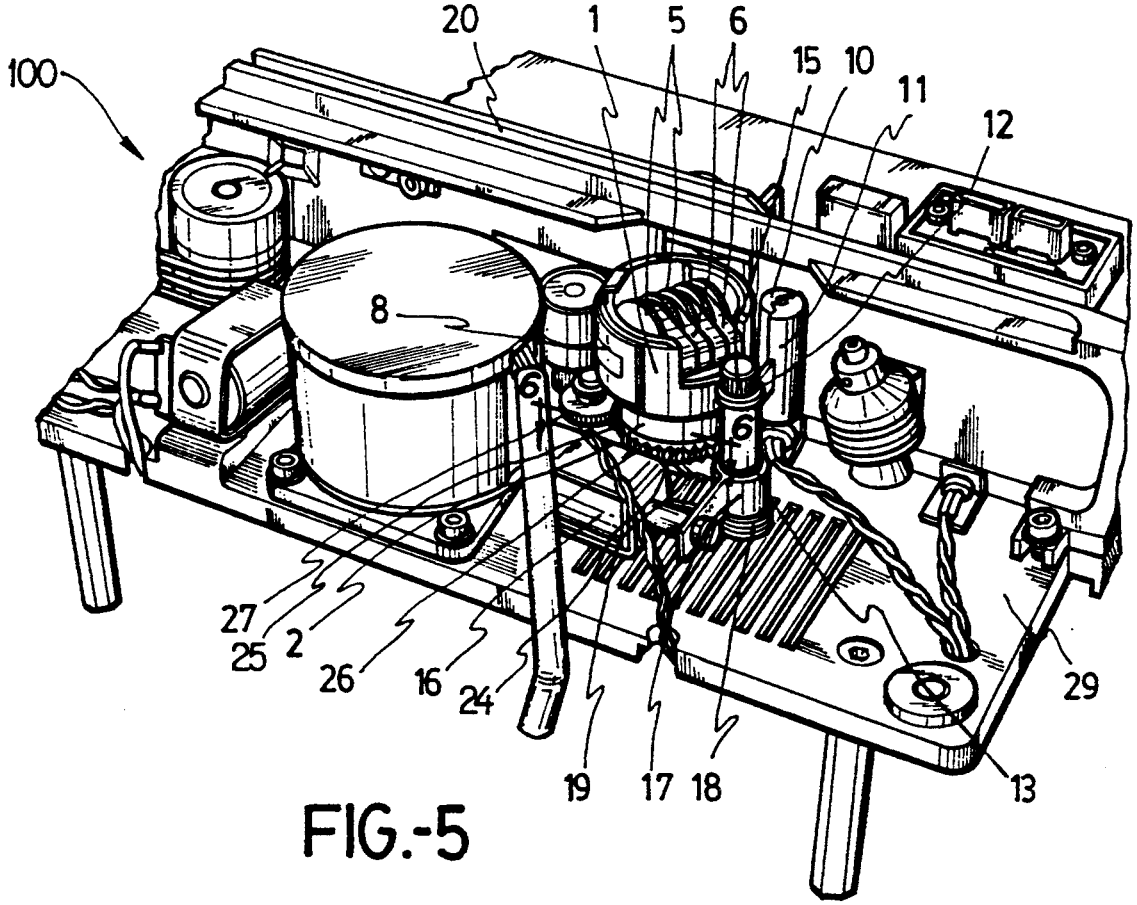
FIG. 5 is a perspective view of the device for printing endorsements illustrated in FIGS. 1–4 mounted on a reading/printing type document processing system.

The cylindrical outer housing 1, which is mounted by the neck 2 to a document processing system 100, for example, a reader/printer system, in a manner to be more fully described with respect to FIG. 5, is further provided with a projecting ring gear 24 integrally formed at the lower end of the neck 2. The predominant portion of the outer circumference of the ring gear 24 is toothed but also includes a toothless section 25. As may be seen in FIG. 5, the cylindrical outer housing 1 engages the transmission system of the document processing system 100 upon which the cylindrical outer housing 1 is mounted thereon by the engagement of the toothed portion of the ring gear 24 and a pinion 27 included as part of the transmission system of the document processing system 100. Similarly, the cylindrical outer housing 1 disengages the transmission system of the document processing system 100 when the toothless section 25 causes the pinion 27 to disengage the ring gear 24. Thus, when the transmission system of the document processing system 100 rotates, the cylindrical housing 1, and thus the document for printing endorsements, will either rotate to print an endorsement on a document or not rotate, depending on an electronic command issued by the document processing system 100 in a manner to be more fully described below.

Now collectively referring to FIGS. 1, 2 and 3, the endorsing stamp carried by the cylindrical outer housing 1 will now be described in greater detail. While only one embodiment of the configuration of the endorsing stamp is to be described herein, it is fully contemplated that numerous alternate embodiments of the configuration of the endorsing stamp will be satisfactory for use in conjunction with the teachings of the present invention. As may be seen in FIG. 1, a depression 30 is formed in the exterior surface 1*a* of the cylindrical outer housing 1. A piece of rubber or a similar material 8 which bears a stamp or other identifying or characterizing mark (not shown) to be printed on documents during an endorsement process, is attached to a plate support 9. In turn, the plate support 9 is embedded in the depression 30 formed in the exterior surface 1*a* such that the stamp, like the characters or digits provided on the belt 6, form a substantially continuous surface with the exterior surface 1*a* of the cylindrical outer housing 1. To change the stamp or other identifying or characterizing mark to be printed on the document, the material 8 bearing the stamp and the plate support 9 are pulled out of the depression 30 by exerting an outwardly orientated axial pressure on the plate support 9. An inwardly orientated axial pressure may then be exerted on a second plate support 9 carrying a second piece of material 8 bearing a second stamp to mount the second stamp in the depression 30.

Figure 4:
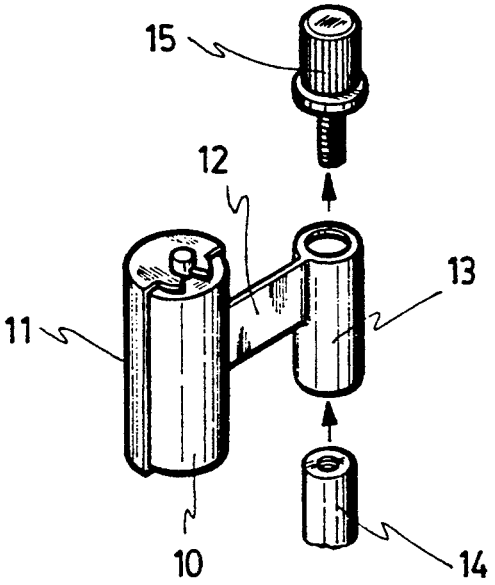
FIG. 4 is a partially exploded view of an inking roller for inking the device for printing endorsements illustrated in FIGS. 1–3.

Referring next to FIGS. 4 and 5, an inking roller 10, which is also mounted on the document processing system 100, will now be described in greater detail. The inking roller 10, which is to be mounted adjacent to and generally parallel with the rotatable cylindrical outer housing 1 such that the inking roller 10 will tangentially contact the bands 6 and the material 8 when the cylindrical outer housing 1 rotates, is connected to a semi-housing 11. A support arm 12 extends from the semi-housing 11 and terminates in a hollow cylindrical arm 13 positioned generally parallel to the semi-housing 11. The hollow cylindrical arm 13 is mounted on a column 14 integrally formed with and upwardly extending from the document processing system 100 by a screw 15. If desired, for example, when the inking roller 10 is not providing sufficient amounts of ink to the bands 6 and the material 8 during the aforementioned tangential contact, the inking roller 10 and semi-housing 11 may be removed from the document processing system 100 by removing the screw 15 and lifting the inking roller 10 and semi-housing 11 upwardly from the column 14 of the document processing system 100. A second inking roller 10 may then be installed in place of the first inking roller 10.

Referring next to FIG. 5, the relationship of the device for endorsing documents illustrated in FIGS. 1–3, and a document processing system 100 upon which the device for endorsing documents is mounted thereon, shall now be described in greater detail. An electromagnet 16, which is mounted on the document processing system 100 includes a core (not shown) which acts on an arm or pawl 17. When the electromagnet 16 is in a first or rest state, the spring 18 exerts a biasing force on the arm or pawl 17 such that the arm or pawl 17 is in locked engagement with the projection 3. As a result of the locked engagement of the arm or pawl 17 and the projection 3, the cylindrical outer housing 1 is prevented from rotating. Furthermore, when the arm or pawl 17 is in locked engagement with the projection 3, the pinion 27 faces the toothless section 25 of the ring gear 24, thereby preventing the pinion 27 from meshing with the ring gear 24 to rotate the cylindrical outer housing 1.

When the electromagnet 16 is activated as a result of receiving a command, the electromagnet 16 enters a second or active state. In this state, the electromagnet 16 will act on the arm or pawl 17 to release the arm or pawl 17 from its locked engagement with the projection 3, thereby permitting the cylindrical outer housing 1 to rotate. In order to release the arm or pawl 17 from the projection 3, a spring 19 disposed beneath the outer cylindrical housing 1 will exert a small rotational biasing force on the cylindrical outer housing 1 at the moment the electromagnet is activated, thereby initiating a rotational movement by the cylindrical outer housing 1 which will produce the release of the arm or pawl 17 with respect to the projection 3. The rotational movement of the cylindrical outer housing 1 produced by the rotational biasing force of the spring 19 will rotate the ring gear 24 a sufficient distance such that the pinion 27 will mesh with the toothed portion of the ring gear 24, thereby rotating the cylindrical outer housing 1. As the transmission system of the document processor system 100 is now connected to the ring gear 24, the cylindrical outer housing 1 will begin a single rotation.

Figure 2:
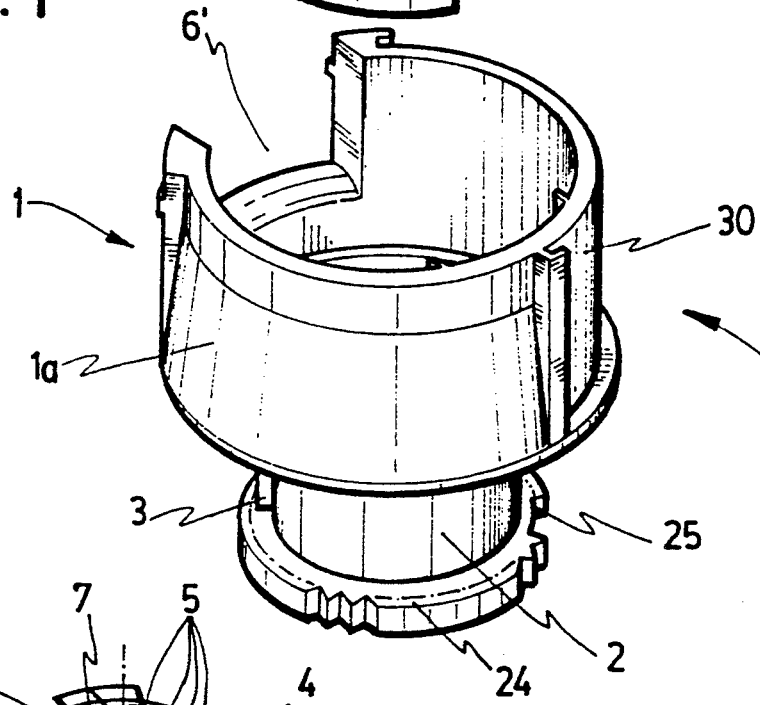
FIG. 2 is a top plan view of the device for printing endorsements illustrated in FIG. 1 positioned to project through an opening in a document guide through which documents to be endorsed are fed therethrough.
Figure 2:
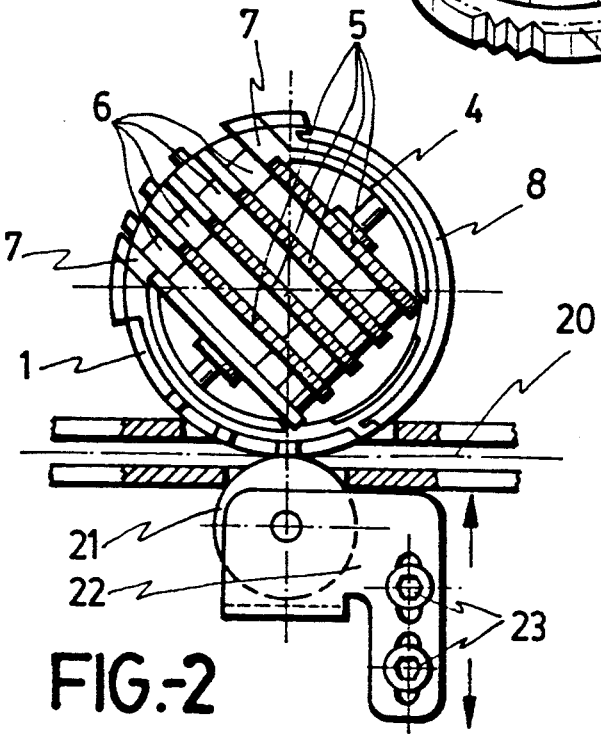
Figure 3:
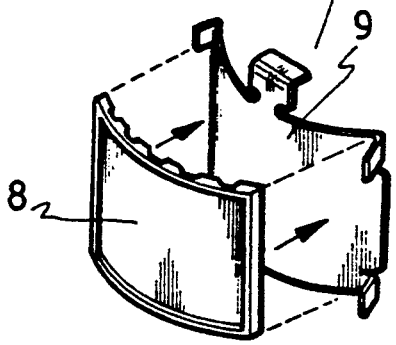
FIG. 3 is an exploded view of an endorsing stamp for mounting on the device for printing endorsements illustrated in FIGS. 1–2.

Collectively referring next to FIGS. 2 and 5, the cylindrical outer housing 1 of the device for endorsing documents is mounted proximate to a document guide 20 through which documents to be endorsed pass therethrough in a location whereby the exterior surface 1*a* of the cylindrical outer housing 1 projects through an opening 20*a* in the document guide 20. On the opposite side of the document guide 20, a die roller 21, which acts as a backing plate for cylindrical outer housing 1, is mounted on the document processing system 100 by a spring 22 such that the exterior surface of the die roller 21 projects through an opening 20*b* in the document guide 20 to tangentially contact the exterior surface 1*a* of the cylindrical outer housing 1. Adjustment screws 23 are provided in order to increase or decrease the pressure of the die roller 21 against the cylindrical outer housing 1. When a document passes through the document guide 20 and between the cylindrical outer housing 1 and the die roller 21, the rotation of cylindrical outer housing 1 is then permitted by the activation of the electromagnet 16 and the subsequent release of the locking engagement between the arm or pawl 17 and the projection 3. The spring 19 then exerts its small rotational biasing force to begin rotation of the cylindrical outer housing 1 which will then continue to be driven by the transmission system of the document processing system 100 once the pinion 27 and the toothed portion of the ring gear 24 mesh together. As a result, the stamp and the digits or characters provided on the material 8 and the bands 6, respectively, which form the aforementioned substantially continuous surface with the exterior surface 1*a* of the cylindrical outer housing 1, will project through the opening 20*a* in guide 20 and press against the document and the die roller 21, thereby stamping an endorsement on the back of the document.

When the cylindrical outer housing 1 has completed a full rotation, i.e. rotated 360 degrees, the cylindrical outer housing 1 is again stopped by the locking action between the arm or pawl 17 and the projection 3. At this point, the pinion 27 will again face the toothless section of the ring gear 24, thereby resulting in the disengagement of the cylindrical outer housing 1 from the transmission system of the document processing system 100. Cylindrical outer housing 1 will not again rotate until the electromagnet 16 receives another command and is again activated.

Figure 6:
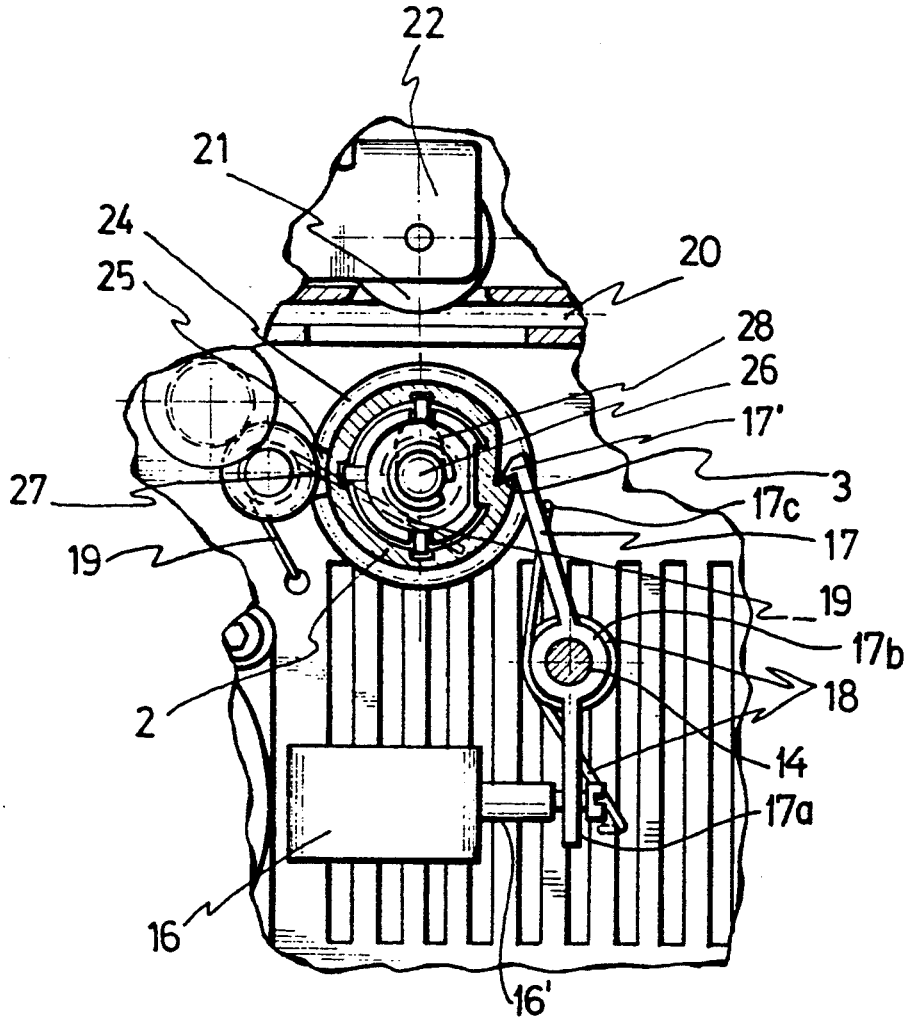
FIG. 6 is a top plan view of the device for printing endorsements illustrated in FIGS. 1–5 which includes a cross-sectional sectional view of the rotatable cylindrical housing which cross-sectional view is taken along 6—6 in FIG. 5.

Referring next to FIG. 6, a top plan view of the device for printing endorsements which better illustrates certain aspects of the rotation of the cylindrical outer housing 1 may now be seen. As may be seen herein, the arm or pawl 17 consists of a first section 17*a* attached to the core 16' of the electromagnet, a center section 17*b* wrapped around the column 14 and a second section 17*c* which extends outwardly toward the cylindrical outer housing 1 at an acute angle with respect to the first section 17*a*. When the electromagnet 16 enters the first state, the electromagnet core 16' acts on the first section 17*a* to displace the second section 17*c* into the path of the rotating cylindrical outer housing 1 where contact occurs by the engagement of a projection 17' which extends from the end of the second section 17*c* of the arm or pawl 17 and the oblique step or indentation 3 of the neck 2. As the spring 18 is attached to the arm 17 on one end and to the base plate of the document processing system 100, the spring 18 then pulls the arm 17 into a locked engagement with the oblique step or indentation 3.

When the electromagnet 16 then enters the second state, electromagnet core 16' withdraws into the electromagnet 16, thereby moving the second section 17*c* of the arm or pawl 17 away from the oblique step or indentation 3. Having thus released the locked engagement of the arm or pawl 17 and the oblique step or indentation 3, expansion spring 19 exerts a force on the cylindrical housing 1 which forwardly displaces the housing a distance sufficient to permit re-engagement of the pinion 27 and the toothed portion of the ring gear 24. More specifically, the spring 19 tends to move the cylindrical outer housing 1 from the inoperative position illustrated in FIG. 6 to the operative position shown in FIG. 2. The side movement or swivel of the cylindrical outer housing 1 is possible because the shaft 26 of the cylindrical outer housing 1 plays in a wide hole 28 in support 29. In this manner, the oblique step or indentation 3 immediately leaves the projection 17 when the electromagnet 16 is energized, thereby providing for the efficient release of the cylindrical outer housing 1. At the same time, the cylindrical outer housing 1 turns slightly for the ring gear 24 to interlock with the pinion 27, thereby executing one whole revolution until the indentation 3 again comes up against projection 17', where the cylindrical outer housing 1 is again halted.

Thus, there has been described and illustrated herein, a device for printing endorsements on documents passing through a document processing system. However, those skilled in the art will recognize that numerous modifications and variations besides those specifically mentioned may be made in the techniques described herein without departing substantially from the concept of the present invention. Specifically, it is fully contemplated that the materials, shapes, size and layout of the elements may be altered provided that such alteration entails no modification of the essential features of the invention. Accordingly, it should be clearly understood that the form of the invention described herein is exemplary only, that the terms used to describe the invention should be taken to have a broad rather than a restrictive meaning, and that such terms are not intended to act as a limitation on the scope of the present invention.

What is claimed is:

1. In a document processing system of the type which reads characters from and prints characters onto documents and which includes a document guide and means for driving documents through said document guide, an apparatus for printing endorsements on documents passing through said document guide comprising:

a rotatable cylindrical body having a lower end with an exterior surface and an indentation on said exterior surface;

print means attached to said rotatable cylindrical body;

a circular ring gear attached to said lower end of said rotatable cylindrical body, said ring gear having teeth along a portion only of its circumference;

a rotatable pinion for engaging the teeth along said portion only of said ring gear's circumference to rotate said rotatable cylindrical body, said rotatable pinion mounted on a shaft;

means for lockedly engaging said indentation on said exterior surface of said rotatable cylindrical body, said means for lockedly engaging comprising a locking arm; and means for moving said locking arm into and out of locked engagement with said indentation on said exterior surface of said rotatable cylindrical body, whereby said locking arm may be moved out of said locked engagement when a document is passing through said document guide, thereby permitting said rotatable cylindrical body to rotate and print an endorsement on said document, and thereupon said locking arm may be moved back into locked engagement with said indentation on said exterior surface of said rotatable cylindrical body.

2. An apparatus for printing endorsements according to claim 1 and further comprising first spring means for biasing said locking arm into locked engagement with said indentation on said exterior surface of said cylindrical body.

3. An apparatus for printing endorsements according to claim 2 and further comprising an electromagnet connected to said locking arm, said electromagnet energizable to permit said cylindrical body to rotate by displacing said locking arm such that it no longer lockedly engages said indentation.

4. An apparatus for printing endorsements according to claim 3 wherein said locking arm is comprised of a first section connected to said electromagnet and a second section for lockedly engaging said indentation, said first and second sections formed at an acute angle to each other.

5. An apparatus for printing endorsements according to claim 2 and further comprising second spring means for imparting rotational bias to said cylindrical body, said second spring means begining to rotate said cylindrical body when said electromagnet is energized, said second spring means rotating said cylindrical body a sufficient distance such that said toothed portion of said ring gear engages said pinion.

6. An apparatus for printing endorsements according to claim 5 and further comprising a base member having portions defining a slot formed therein, said rotatable cylindrical body further comprising a central shaft, said central shaft inserted in said slot to mount said rotatable cylindrical body on said base member.

7. An apparatus for printing endorsements according to claim 6 wherein said slot is wider than said central shaft, and wherein said second spring means rotates said cylindrical body by displacing said central shaft within said slot.

8. An apparatus for printing endorsements according to claim 7 wherein said second spring means and said rotatable pinion are both mounted on said shaft.

9. An apparatus for printing endorsements according to claim 8 wherein said rotatable cylindrical body comprises an inner housing and portions defining a notch, wherein said print means further comprises at least one band having characters or digits thereon, said at least one band supported by said inner housing and projecting through said notch to form a substantially continuous surface with said exterior surface of said rotatable cylindrical body, such that a single character or digit appears on the outside for each of said at least one bands.

10. An apparatus for printing endorsements according to claim 9 wherein said print means further comprises a stamp for printing an endorsement on said documents, said stamp mounted on said exterior surface of said rotatable cylindrical body.

11. An apparatus for printing endorsements according to claim 10 and further comprising an inking roller, said inking roller positioned tangentially to said outer housing so that said characters or digits disposed on said at least one band forming said substantially continuous surface with said outer housing and said stamp mounted on said exterior surface of said outer housing contact said inking roller when said outer housing rotates.

12. An apparatus for printing endorsements according to claim 11 and further comprising a second shaft mounted on said base member, and wherein said inking roller and said first spring means are swivellingly mounted on said second shaft.

13. An apparatus for printing endorsements according to claim 12 and further comprising a tangential roller mounted on said base member, and wherein said rotatable housing and said tangential roller are mounted in near tangential contact on opposite sides of said document guide.

* * * * *

UNITED STATES PATENT AND TRADEMARK OFFICE

CERTIFICATE OF CORRECTION

PATENT NO. : 5,347,924

DATED : September 20, 1994

INVENTOR(S) : Emilio B. Martin

It is certified that error appears in the above-indentified patent and that said Letters Patent is hereby corrected as shown below:

In the Abstract, Line 8: Delete "continuos"; insert --continouos--

Column 3, Line 44: Delete "tis"; insert --its--

Column 3, Line 66: Delete "sectional view"; insert --view--

Signed and Sealed this

Fourteenth Day of March, 1995

*Attest:*

*Attesting Officer*

BRUCE LEHMAN

*Commissioner of Patents and Trademarks*